US005885738A

United States Patent [19]

Hannon

[11] Patent Number: 5,885,738

[45] Date of Patent: Mar. 23, 1999

[54] METHOD FOR MAKING AND USING AN IMPROVED DURABLE PRINTABLE SHEET

[75] Inventor: Gregory E. Hannon, Newark, Del.

[73] Assignee: W. L. Gore & Associates, Inc., Newark, Del.

[21] Appl. No.: 847,546

[22] Filed: Apr. 23, 1997

Related U.S. Application Data

[60] Continuation of Ser. No. 419,343, Apr. 10, 1995, abandoned, which is a division of Ser. No. 373,350, Jan. 17, 1995, abandoned.

[51] Int. Cl.[6] ..... G03G 7/00; B05D 1/32; B05D 5/00

[52] U.S. Cl. ..... 430/97; 430/120; 427/261; 427/282; 427/407.1; 134/38; 134/40; 101/483

[58] Field of Search ..... 430/120, 97; 427/282, 427/261, 407.1, 181, 197, 352; 134/38, 40; 101/483

[56] References Cited

U.S. PATENT DOCUMENTS

| | | | |
|---|---|---|---|
| 3,287,149 | 11/1966 | Dooley et al. | 117/15 |
| 3,871,947 | 3/1975 | Brekken | 161/116 |
| 3,953,566 | 4/1976 | Gore | 264/288 |
| 4,246,153 | 1/1981 | Takagishi et al. | 260/29.4 R |
| 4,256,459 | 3/1981 | Russell et al. | 8/471 |
| 4,384,040 | 5/1983 | von Meer | 430/532 |
| 4,532,316 | 7/1985 | Henn | 528/59 |
| 4,587,169 | 5/1986 | Kistner | 428/413 |
| 4,619,949 | 10/1986 | Kistner | 522/170 |
| 4,796,046 | 1/1989 | Suzuki et al. | 355/3 FU |
| 4,818,776 | 4/1989 | Koleske | 522/31 |
| 4,902,423 | 2/1990 | Bacino | 210/500.36 |
| 4,966,804 | 10/1990 | Hasegawa et al. | 428/203 |
| 5,013,621 | 5/1991 | Kistner | 430/11 |
| 5,017,908 | 5/1991 | Macpherson | 340/605 |
| 5,022,947 | 6/1991 | Hasegawa et al. | 156/277 |
| 5,104,400 | 4/1992 | Berguer et al. | 264/132 |
| 5,126,182 | 6/1992 | Lumb et al. | 428/90 |
| 5,132,146 | 7/1992 | Maruyama et al. | 427/288 |
| 5,233,924 | 8/1993 | Ohba et al. | 101/483 |
| 5,273,551 | 12/1993 | Brehme et al. | 8/500 |
| 5,279,854 | 1/1994 | Kendall et al. | 427/194 |
| 5,357,058 | 10/1994 | Tanihara et al. | 174/112 |

*Primary Examiner*—Christopher D. Rodee
*Attorney, Agent, or Firm*—Carol A. Lewis White

[57] ABSTRACT

The present invention is an improved printable sheet for use in a variety of applications requiring extreme image durability and weather (e.g., water) resistance. The printable sheet of the present invention employs an expanded polytetrafluoroethylene sheet comprising a series of polymeric nodes interconnected by fibrils. Images can be applied to this sheet using a variety of means, including pen and ink, electrostatic printing, screen printing, offset printing, etc. These images have proven to be very durable and capable of substantial wear, water exposure, and general abuse. Moreover, the printable sheet of the present invention is capable of being cleaned and reused over and over again once any given image is no longer of interest.

13 Claims, 3 Drawing Sheets

METHOD FOR MAKING AND USING AN IMPROVED DURABLE PRINTABLE SHEET

RELATED APPLICATIONS

This application is a continuation, of application Ser. No. 08/419,343 filed Apr. 10, 1995, abandoned which is a divisional of U.S. patent application Ser. No. 08/373,350 filed Jan. 17, 1995, abandoned.

BACKGROUND OF THE INVENTION

1. Field of the Invention

The present invention relates to durable substrates for displaying printed images (e.g., images produced by lithography, photolithography (e.g., xerographic copying), screen printing, gravure printing, offset printing, etc.), and methods for producing and using such substrates.

2. Description of Related Art

There has been a demand over the years for a durable substrate for use as a printable sheet. Whether for use with hand writing instruments, offset printing, xerographic printing processes (e.g., photocopiers, laser printers, or fax machines), screen printing, etc., there are many applications where a flexible, weatherproof material is desirable. For example, maps and other charts for outdoor use (e.g., ship charts, road and backpacking maps, schematic drawings for outdoor workers, etc.) are often exposed to extreme weather conditions and are regularly abused during use, such as by crumpling, improper folding, or being soiled with food, drink or dirt. Extreme environments have even more taxing demands, such as that encountered by charts or other documents used underwater.

A number of materials have been proposed to address some of these demands. For instance, a wide variety of coating materials have been proposed for use on conventional paper materials. Examples of such coatings are disclosed in U.S. Pat. No. 4,966,804 to Hasengawa et al., and 5,0313,621 to Kistner. While these materials may work adequately well for some applications, they all have undesirable limitations. Materials that are coated after application of the printed image are not readily amenable to a durable correction or modification after treatment. A more pressing concern is that coated paper products have only limited ability to withstand exposure to water or other weathering conditions. Breakdown under these conditions is even more pronounced when the materials are subjected to repeated folding or crumpling that may weaken or destroy the protective coating.

A number of other materials are employed that are fully weather resistant. One example of such material is described in U.S. Pat. No. 3,871,947 to Brekken. This material is a polymer film of polyethylene terephthalate, such as that used as an adhesive tape. While this material is far more weather resistant than coated paper materials, it tends to provide only a weak adhesion to most print media. As a result, most printed images will not remain on this type of material when subjected to active use or weathering. Another problem with plastic materials of this type is their expense both in production and printing. Although plastic materials are far more durable in use, they are generally incapable of reuse (i.e., permanent inks that must be used on these materials are not generally capable of removal) and these materials may present serious disposal concerns.

One common material used for applications where a permanent, weatherproof printed material is needed is spun bonded nonwoven high density polyethylene material sold under the trademark TYVEK by E. I. duPont de Nemours and Company, Inc. This material is highly tear-resistant and will withstand extensive exposure to water or other weathering conditions. As a result, images are often applied to this material where durability and weather-resistance is needed (e.g., backpacking maps and similar applications where the material may get wet or soiled). Despite improvements in durability, repeated exposure to water, and particularly the rigors of machine washing, demonstrates that the images on TYVEK maps will readily fade and the material will lose its shape. Accordingly, this material can be considered only moderately durable and not suitable for repeated exposure to extreme conditions. TYVEK material also continues to suffer from the problems of other plastic materials outlined above, such as compatibility with only certain print materials, inability to be readily cleaned and reused, and possible disposal problems following use.

Although it would be desirable to provide a print substrate that will accept and retain a wide variety of print images through severe water exposure and other extreme conditions, until the present invention no such material has been available. Of particular interest would be a print substrate that can retain images produced by a xerographic print process (e.g., from photocopiers or laser printers) through repeated exposure to water and abuse through robust use. Of even greater interest would be a material that can both successfully retain an image during use and also be readily cleaned and reused repeatedly as desired.

These and other purposes of the present invention will become evident from review of the following specification.

SUMMARY OF THE INVENTION

The present invention is an improved printable sheet for use in displaying a variety of printed images and method for using such a sheet. The printable sheet of the present invention comprises an image layer of expanded polytetrafluoroethylene (PTFE) comprising a surface of polymeric nodes interconnected by fibrils. Preferably, this image layer is attached to a dimensionally stable support sheet to aid in maintaining the shape of the printable sheet. It has been determined that a variety of images can be applied to the image layer, with the printed image attaching to and within this structure to produce both a clear image and one that is well protected from attack during use. Thus, images applied in accordance with the present invention are highly durable and will withstand substantial wear, weathering (including complete water submersion), and abuse without serious damage to either the image or the printable sheet. Among the printing processes that have proven satisfactory for use with the present invention are electrostatic copying, screen printing, conventional pen and ink writing, and offset printing.

A further inventive aspect of the present invention is that the printable sheet is capable of being cleaned and reprinted. The printable sheet's durability and chemical resistance allows the image layer to be cleaned of old images using appropriate solvents (without damaging the image layer) and then re-printed. As a result, the printable sheet of the present invention has the unique ability of being both highly durable and being readily reusable once the original image is no longer of interest.

The printable sheet of the present invention has endless possible applications, including serving as an easily printable durable surface for use under extreme conditions, such as in maps, field guides, outdoor writing tablets, specifications and other printed matter for use underwater, blueprints for outdoor construction, etc.

DESCRIPTION OF THE DRAWINGS

The operation of the present invention should become apparent from the following description when considered in conjunction with the accompanying drawings, in which.

DETAILED DESCRIPTION OF THE INVENTION

The present invention is an improved printable sheet for displaying a printed image. The term "printed image" is intended to include any kind of print medium that is used to record an image (e.g., words, pictures, drawings, tables, etc.) on a surface. As is explained in greater detail below, print media contemplated by the present invention include a variety of inks (e.g., pen ink, screen print inks, or printer's ink), printer toner and other particulate materials, xerographic toner, etc.

Figure 1:
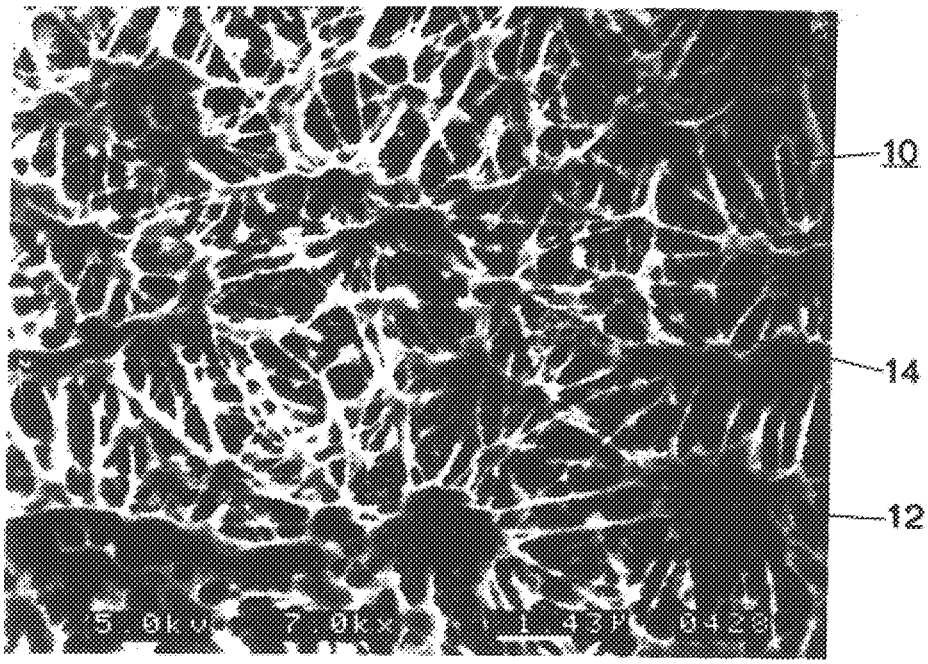
FIG. 1 is a plan view scanning electron micrograph (SEM) enlarged 7,000 times of one embodiment of an expanded polytetrafluoroethylene (PTFE) material for use as an image layer of the present invention.
Figure 2:
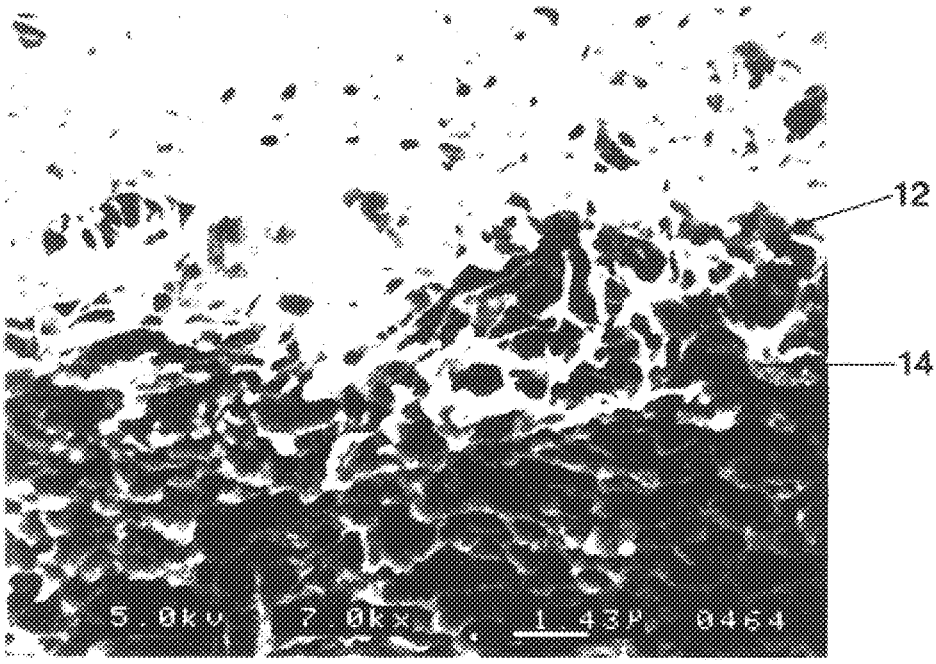
FIG. 2 is a three-quarter view SEM enlarged 7,000 times of an expanded PTFE material of the present invention.

FIGS. 1 and 2 are scanning electron micrographs (SEM) of image layers of a printable sheet of the present invention. The image layer 10 comprises a polymer material that includes a microporous structure of polymeric nodes 12 interconnected by fibrils 14. As is explained in greater detail below, preferably the image layer comprises an expanded polytetrafluoroethylene (PTFE) material, such as that made in accordance with U.S. Pat. No. 3,953,566 to Gore, incorporated by reference.

Expanded PTFE has a number of important properties that make it particularly suitable as a durable print display surface of the present invention. First, PTFE is a highly inert material that is hydrophobic. Accordingly, the material is resistant to both water and a wide variety of other materials that commonly damage paper and similar printed surfaces. Additionally, by expanding PTFE in the manner taught by U.S. Pat. No. 3,953,566 to form a node and fibril structure, the material undergoes a significant increase in tensile strength and becomes highly flexible. Moreover, while full density PTFE material tends to be a poor surface for retaining a printed image, since the material is so slippery and resistant to adhesion that most ink or other print media will not readily adhere to it, it has been discovered that the node and fibril structure of expanded PTFE provides a textured surface that will very effectively retain certain print media thereon and therein.

The preferred printable sheet of the present invention is made in the following manner. A fine powder PTFE resin is blended with a lubricant, such as odorless mineral spirits, until a compound is formed. The volume of lubricant used should be sufficient to lubricate primary particles of the PTFE resin so to minimize the potential of the shearing of the particles prior to extruding.

The compound is then compressed into a billet and extruded, such as through a ram type extruder, to form a coherent sheet of extrudate. A reduction ratio of about 30:1 to 300:1 may be used (i.e., reduction ratio=cross-sectional area of extrusion cylinder divided by the cross-sectional area of the extrusion die). For most applications a reduction ratio of 75:1 to 100:1 is preferred.

The lubricant may then be removed, such as through volatilization, and the dry coherent extrudate sheet is expanded rapidly in at least one direction about 1.1 to 50 times its original length (with about 1.5 to 2.5 times being preferred). Expansion may be accomplished, such as through the method taught in U.S. Pat. No. 3,953,566, by passing the dry coherent extrudate over a series of rotating heated rollers or heated plates at a temperature of between about 100° and 325° C. Alternatively, the extruded sheet may be expanded in the manner described in U.S. Pat. No. 4,902,423 to Bacino, prior to removal of the lubricant.

In either case, the material may be further expanded at a ratio of 1:1.1 to 50:1 (with 5:1 to 35:1 being preferred) to form a final microporous sheet. Preferably the sheet is biaxially expanded so as to increase its strength in both its longitudinal and transverse directions. Finally, the material may be subjected to an amorphous locking step by exposing it to a temperature in excess of 340° C.

The final sheet preferably comprises the following mean properties: thickness of about 1.6 mils; resistance to air flow (Gurley Number) of about 6.0 sec.; bubble point of about 21.2 psi; mass/area of about 17.7 g/m$^2$; matrix tensile strength in the longitudinal direction of about 7,014 psi and in the transverse direction of about 14,353 psi; maximum pore size of 0.43 micron; minimum pore size of 0.27 microns; and mean pore size of 0.34 microns.

The resistance of the membrane to air flow was measured by a Gurley densometer (in accordance with ASTM Standard D726-58) manufactured by W. & L. E. Gurley & Sons. The results are reported in terms of Gurley Number which is the time in seconds for 100 cubic centimeters of air to pass through 1 square inch of a test sample at a pressure drop of 4.88 inches of water.

The Bubble Point of porous PTFE was measured using isopropyl alcohol following ASTM Standard F316-86, incorporated by reference. The Bubble Point is the pressure of air required to blow the first continuous bubbles detectable by the their rise through a layer of isopropyl alcohol covering the expanded PTFE media. This measurement provides an estimation of maximum pore size.

Tensile strength is determined by the method described in ASTM D882, incorporated by reference, using an INSTRON tensile strength tester.

Figure 3:
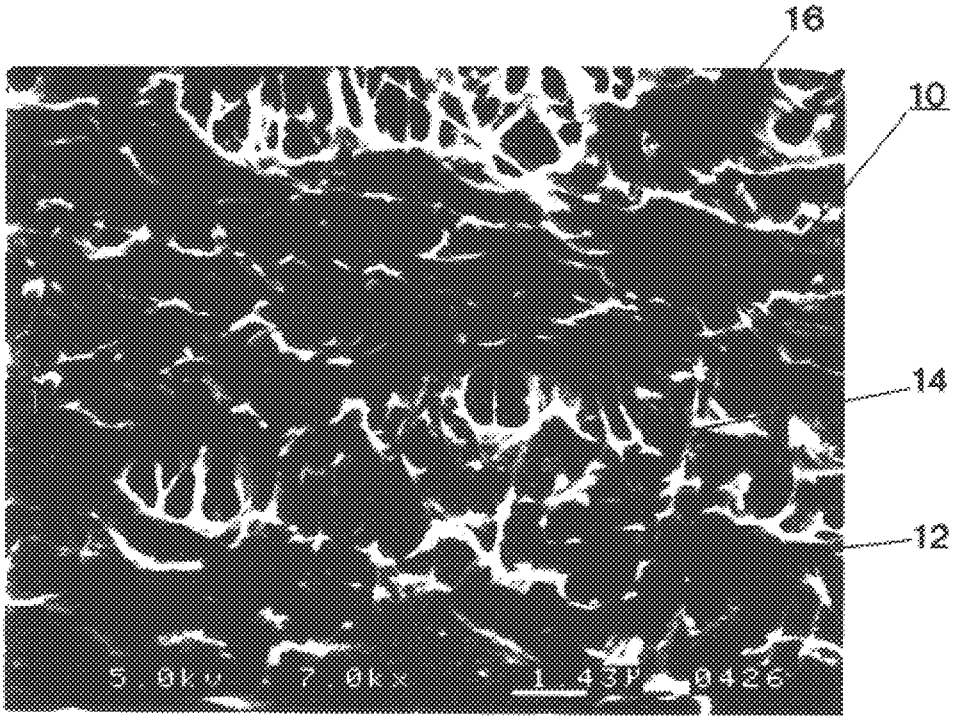
FIG. 3 is a plan view SEM enlarged 7,000 times of an expanded PTFE image layer of the present invention showing a printed image bonded thereto.
Figure 4:
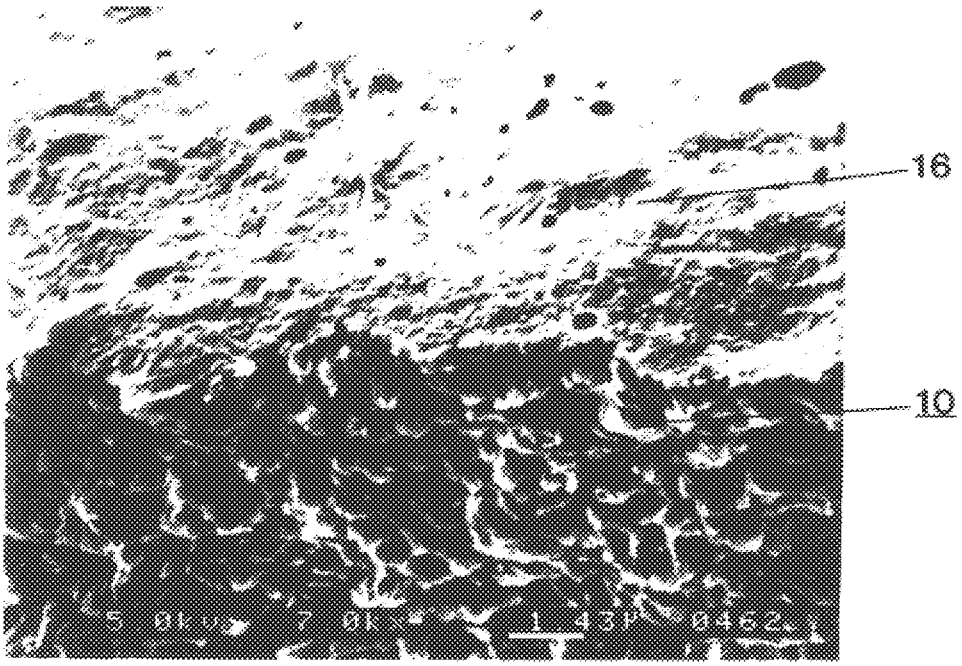
FIG. 4 is a three-quarter view SEM enlarged 7,000 times of an expanded PTFE image layer of the present invention showing a printed image bonded thereto.
Figure 5:
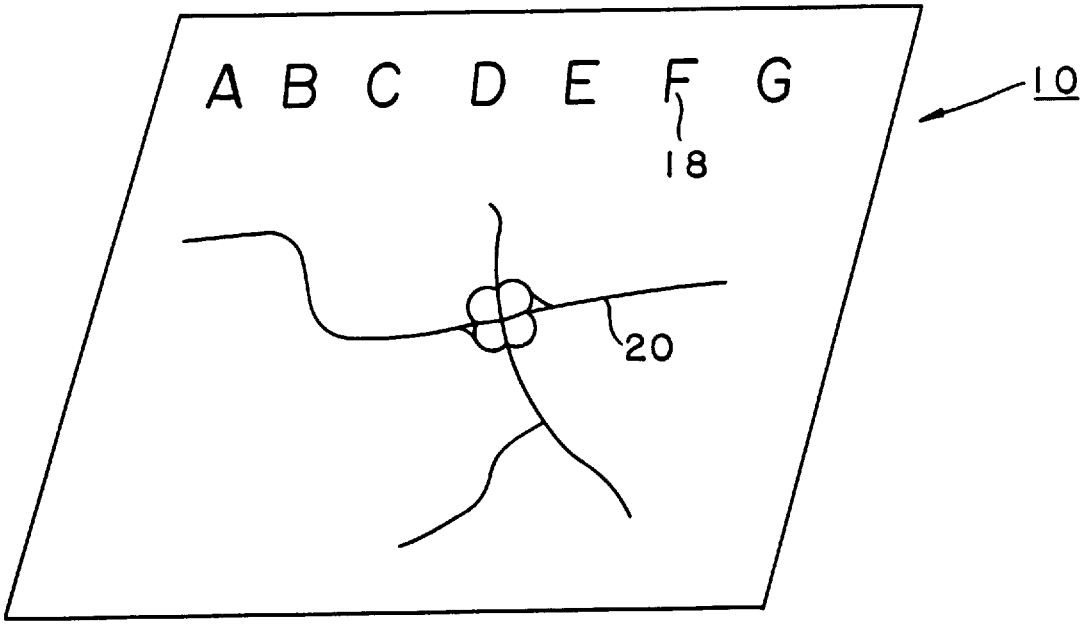
FIG. 5 is a three-quarter isometric view of a durable printable sheet of the present invention, displaying printed images thereon.

It has been determined that by providing a microporous surface of polymeric nodes and fibrils, such as that of expanded PTFE, a printed image can be coated onto and into the node and fibril structure so as to establish a surprisingly durable bond between the printed image and the image layer. As is shown in the SEMs of FIGS. 3 and 4, the printed image 16 is actually interwoven into the surface of the expanded PTFE where the microporous structure of the material serves to shield the image from wear or attack during use. As is shown in FIG. 5, the printable sheet 10 of the present invention can be formed into any suitable shape and may have virtually any form of image applied to it, including writing 18, charts or map lines 20, etc.

Figure 6:
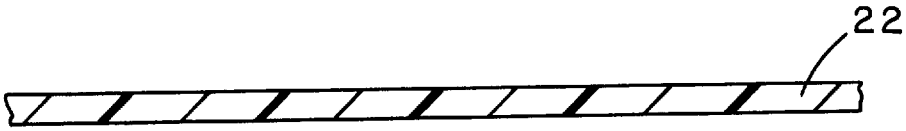
FIG. 6 is a cross-section view of one embodiment of a durable printable sheet of the present invention, comprising a single layer of expanded PTFE material.
Figure 7:
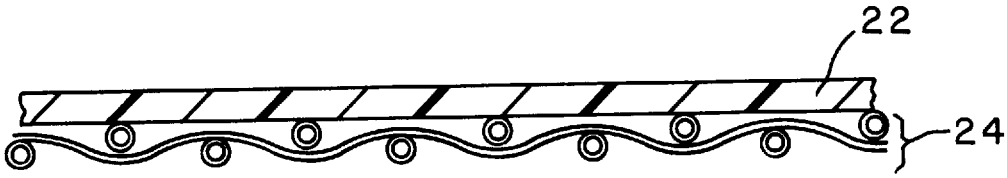
FIG. 7 is a cross-section view of another embodiment of a durable printable sheet of the present invention, comprising a layer of expanded PTFE material bonded to a support layer.

The present invention may comprise a single or multiple layers of expanded PTFE 22, as is shown in FIG. 6, or may comprise a laminate of expanded PTFE 22 and a backing support material 24, as is shown in FIG. 7. Since the expanded PTFE membrane alone tends to be susceptible to stretching and distortion, it is preferred that the membrane be mounted to a support layer 24, such as through lamination to a woven or non-woven fabric material, that will help maintain the shape of the image layer during use. Suitable support layer materials include paper, woven materials such as nylon taffeta fabric, non-woven materials such as felt fabrics, and continuous polymeric sheets such as urethanes.

A suitable support layer may be laminated in place by applying an adhesive material, such as moisture-cured solvent-free urethane adhesive, to the expanded PTFE membrane and then applying the adhesive-coated expanded PTFE membrane to a fabric material (e.g., nylon taslite, nylon taffeta). The two materials can then be bonded to each other under applied pressure, such as by rolling the material between one or more pairs of nip rollers. With use of a moisture curable polyurethane adhesive to bond an expanded PTFE membrane to a woven fabric, such as nylon taffeta, pressure of 100 pound per linear inch are applied to bond the materials together. The materials are then allowed to moisture cure for a period of about 48 hours before use.

A durable water repellent (DWR) may then be applied to the support layer material to provide additional water resistance, if desired. Suitable materials for a DWR coating for use in the present invention include fluoroacrylates or fluorinated urethanes.

A variety of images and print media have been applied to the substrate of the present invention with exceptional durability results. In its simplest form, the durable print substrate of the present invention can be written on with ball-point pens or markers. More surprisingly, the material of the present invention can be loaded through a conventional xerographic printing machine (e.g., a plain paper copier, facsimile machine, or laser printer) to have a particulate toner image applied to the image layer. It has been discovered that the toner material forms a semi-permanent bond within the nodes and fibril structure of the expanded PTFE that will withstand considerable wear and abuse without significant loss of image quality.

An even more durable image can be applied through the use of a screen printing process (e.g., silk screen printing). In these processes a layer of ink (e.g., Pantone 9089 glossy black ink from Naz-Dar Co., Chicago, Ill.) is applied using pressure rollers through a screen to the image layer. As is explained below, images applied in this manner have proven to be extremely durable, far exceeding any previously available durable print surface tested.

Other suitable methods of applying a printed image of the present invention include block printing, offset printing, engraved printing, gravure printing, continuous web printing, etc.

The printed image made in accordance with the present invention is particularly durable with regard to weathering and other water exposure. As will be evident from the following examples, the printable sheet of the present invention can be washed continuously in conventional clothes washing machine (without detergent) for many hours without any serious loss of image quality. With regard to particular printed images, the printable sheet of the present invention will withstand at least 5 hours of continuous washing with a xerographic image; at least 80 hours of continuous washing with a screen printed image; and over 100 hours of continuous washing with an offset printed image. These results demonstrate the durability of both the printable sheet of the present invention and the printed images created thereon and provides good indication of the durability of this material under normal robust outdoor use.

Another important property of the present invention is that the printed image can be removed without damaging the image layer, allowing the material to be used repeated. Due to the very inert nature of PTFE, it can withstand a wide variety of solvent materials without any significant degradation. As such, an image may be removed from the surface using a solvent suitable for a particular print media without damaging the expanded PTFE image layer. In many instances, the image may be removed with no more than a simple wiping of the image with a suitable solvent. For higher volume print surface regeneration or for those print media that form stronger bonds to the expanded PTFE material, the print material may be sprayed, soaked, and/or scrubbed with the solvent, either manually or through mechanized means.

Particular print media and corresponding solvents are set forth below:

| Print Medium | Suitable Solvent |
|---|---|
| Electrostatic copier toner | Acetone |
| Ball-point pen ink | Acetone |
| Screen printing ink (e.g, Pantone 9089) | Acetone |
| Screen printing-vinyl | Acetone |

The printable sheet of the present invention has many possible applications, including serving as an easily printable durable surface for use under extreme conditions (e.g., maps, ship charts, field guides, outdoor writing tablets, specifications and other printed matter for use underwater, blueprints, etc.).

The ability of the printable sheet of the present invention to be folded, crushed, and otherwise "packed" in manners that would quickly destroy paper and similar material makes the printable sheet of the present invention particularly suitable for applications requiring a packable printed surface, such as backpacking and other outdoor maps, specification sheets and other documents that may have to be referred to often and repeatedly re-packed in outdoor settings, such as trail maps for skiing, etc.

Without intending to limit the scope of the present invention, the following examples illustrate how the present invention may be made and used:

EXAMPLE 1

A printable sheet of the present invention was prepared in the following manner.

A fine powder PTFE resin was combined with an odorless mineral spirit. The volume of mineral spirits used per gram of fine powder PTFE resin was 0.275 cc/gm. This mixture is aged below room temperature to allow for the mineral spirits to become uniformly distributed within the PTFE fine powder resin. This mixture was compressed into a billet and extruded at approximately 8300 kPa through a 0.71 mm gap die attached to a ram type extruder to form a coherent extrudate. A reduction ratio of 75:1 was used.

The extrudate is then rolled down between two metal rolls which were heated to between 30°–40° C. The final thickness after roll down was 0.20 mm. The material was transversely expanded at a ratio of 3:1 and then the mineral spirits were removed from the extrudate by heating the mass to 240° C. (i.e., a temperature where the mineral spirits were highly volatile). The dried extrudate was transversely expanded at 150° C. at a ratio of 3.5:1. After expansion, the sheet was amorphously locked at greater than 340° C. and cooled to room temperature. This material forms a relatively fine expanded structure such as that shown in FIG. 2.

This membrane was then laminated to a nylon taffeta fabric material by applying to one surface a moisture curable adhesive in a discrete dot pattern by a gravure roll. The fabric and membrane were then brought together through nip rollers to bond the two sheets together with a pressure of about 100 pounds per linear inch. This laminate was then collected on a round core and the adhesive was allowed to cure for 48 hours. After curing, a water based solution containing a suitable fluoropolymer(acrylate) was applied and the web was then heated to a temperature of at least 150° C. for at least 10 seconds.

EXAMPLE 2

A printed image was applied to the printable sheet made in accordance with Example 1. The material was cut to approximately 8.5×11 inch dimensions and passed through a Sharp SF 8800 photocopy machine employing a Sharp PPC Toner SF-880NT1 Black (comprising styrene-acrylate copolymer, carbon black, organic ammonium salt, and polypropylene). A map image was applied to the printable sheet by simply passing the printable sheet through the photocopy machine in place of conventional copier paper. The printed image formed in this manner was of good quality. The map was capable of being repeatedly folded or crushed (or "packed") and reopened without damage to either the printable sheet or the map image.

To test the fastness of the printed image to the printable under weathering conditions, the printable sheet was exposed to a continuous wash cycle in a conventional clothes washing machine employing only water at a temperature of between 25° C. (for the rinse cycle) and 50° C. (for the wash cycle). The results of this test are summarized below. After 4 hours, the image appeared in essentially its original condition slightly but the printable sheet retained essentially its original shape.

By way of comparison, a similar test was conducted on a commercial map from Wilderness Press, Berkeley, Calif., printed on TYVEK fabric. This map was subjected to washing and failed. The image failed to withstand 3 hours of continuous wash. Further, the TYVEK material tended to lose its shape and dimensions after only a few wash cycles.

EXAMPLE 3

The reusability of the printable sheet of the present invention was then tested using the map image made in accordance with Example 2. Following the washing machine testing, the printed image was removed from the surface of the printable sheet by applying an acetone solvent to the surface. The solvent was wiped across the image layer of the printable sheet absorbed in a porous cellulosic substrate (i.e., paper towel) material. After two (2) wipes, the image was completely removed. The solvent was then allowed to evaporate from the printable sheet. This material was then re-printed using the same process described in Example 2. The new printed image appeared identical to the first in quality and durability.

EXAMPLE 4

A printed image was applied to the printable sheet made in accordance with Example 1 using a screen printing process. The material was cut to approximately 14×14 inch dimensions and Pantone 9089 black glossy type of ink acquired from Naz-Dar Co., Chicago, Ill. was used. The image was applied in a conventional "silk-screening" process whereby an imprintable material was applied as a reverse image to a piece of fine fabric. The Pantone 9089 ink was rolled across the fine fabric to force the ink in the form of the image through the fabric onto the printable sheet of the present invention.

The printed image formed in this manner was of good quality. The material was capable of being repeatedly folded or crushed (or "packed") and reopened without damage to either the printable sheet or the image.

To test the fastness of the printed image to the printable sheet, the printable sheet was exposed to a continuous wash cycle in a conventional washing machine employing a no detergent and water at a temperature of between 25° and 50° C. The results of this test are summarized below.

The printed image appeared in essentially its original form after 100 hours of washing. Also, the sample withstood flexing in a NEWARK flex tester acquired from W. L. Gore & Associates, Inc, of Elkton, Md., at room temperature for 320,000 cycles with no degradation of image.

EXAMPLE 5

A printed image was applied to the printable sheet made in accordance with Example 1 using an offset printing process. The material was cut to approximately 17×24 inch dimensions. The printing was done by using conventional black offset printers ink supplied by Techna-Graphics Inc., Washington, D.C.

The printed image formed in this manner was of good quality. The material was capable of being repeatedly folded or crushed (or "packed") and reopened without damage to either the printable sheet or the image.

To test the fastness of the printed image to the printable sheet, the printable sheet was exposed to a continuous wash cycle in a conventional washing machine employing a no detergent and water at a temperature of between 25° and 50° C. The printed image was washed for 177 hours with no image fade. A 2–3% shrinkage appeared in both directions of the sheet after 20 wash-dry cycles.

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. A method for producing a reusable durable surface for displaying a printed image that comprises providing an image layer comprising an expanded polytetrafluoroethylene (PTFE) having at least one print surface comprising a structure of polymeric nodes interconnected by polymeric fibrils;

applying to the image layer a first printed image formed from a durable print medium to form a durable bond between the print surface and the print medium, whereby the printed image adheres to the polymeric nodes and fibrils while maintaining the node and fibril structure of the image layer;

whereby the printed image remains clearly adhered to the image layer so as to provide a clear printed image that will withstand repeated exposures to water;

changing the printed image on the print surface through the steps of:

cleaning the surface with a solvent that will remove the printed image without damaging the image layer; and applying to the image layer a second printed image formed from a durable print medium to form a durable bond between the print surface and the print medium, whereby the first printed image is applied to the image layer through a xerographic printing process.

2. The method of claim 1 that further comprises reinforcing the image layer by adhering it to a dimensionally stable support layer.

3. The method of claim 1 that further comprises creating a printed image that will withstand at least 5 hours of continuous clothes washing machine washings;

whereby the printed image remains clear following the machine washings.

4. The method of claim 1 that further comprises providing a printed image on the image layer to form a map;

whereby the map is both packable and waterproof.

5. The method of claim 1, wherein both said first printed image and said second printed image are applied to the image layer through a xerographic process.

6. A method for producing a reusable durable surface for displaying a printed image that comprises providing an image layer comprising an expanded polytetrafluoroethylene (PTFE) having at least one print surface comprising a structure of polymeric nodes interconnected by polymeric fibrils;

applying to the image layer a first printed image formed from a durable print medium to form a durable bond between the print surface and the print medium, whereby the printed image adheres to the polymeric nodes and fibrils while maintaining the node and fibril structure of the image layer;

whereby the printed image remains clearly adhered to the image layer so as to provide a clear printed image that will withstand repeated exposures to water;

changing the printed image on the print surface through the steps of:

cleaning the surface with a solvent that will remove the printed image without damaging the image layer; and applying to the image layer a second printed image formed from a durable print medium to form a durable bond between the print surface and the print medium, whereby the first printed image is applied to the image layer through a screen printing process.

7. The method of claim 6 that further comprises creating a printed image that will withstand at least 80 hours of continuous clothes washing machine washings;

whereby the printed image remains clear following the machine washings.

8. The method of claim 6, that further comprises reinforcing the image layer by adhering it to a dimensionally stable support layer.

9. The method of claim 6, wherein both said first printed image and said second printed image are applied to the image layer through a screen printing process.

10. A method for producing a reusable durable surface for displaying a printed image that comprises providing an image layer comprising an expanded polytetrafluoroethylene (PTFE) having at least one print surface comprising a structure of polymeric nodes interconnected by polymeric fibrils;

applying to the image layer a first printed image formed from a durable print medium to form a durable bond between the print surface and the print medium, whereby the printed image adheres to the polymeric nodes and fibrils while maintaining the node and fibril structure of the image layer;

whereby the printed image remains clearly adhered to the image layer so as to provide a clear printed image that will withstand repeated exposures to water;

changing the printed image on the print surface through the steps of:

cleaning the surface with a solvent that will remove the printed image without damaging the image layer; and applying to the image layer a second printed image formed from a durable print medium to form a durable bond between the print surface and the print medium, whereby the first printed image is applied to the image layer through an offset printing process.

11. The method of claim 10 that further comprises creating a printed image that will withstand at least 100 hours of continuous clothes washing machine washings;

whereby the printed image remains clear following the machine washings.

12. The method of claim 10, that further comprises reinforcing the image layer by adhering it to a dimensionally stable support layer.

13. The method of claim 10, wherein both said first printed image and said second printed image are applied to the image layer through an offset printing process.

* * * * *